US011124949B2

(12) United States Patent
Olsson

(10) Patent No.: US 11,124,949 B2
(45) Date of Patent: Sep. 21, 2021

(54) ARRANGEMENT AND METHOD FOR OPERATING A HYDRAULICALLY OPERATED BOOM CARRYING A TOOL

(71) Applicant: HUSQVARNA AB, Huskvarna (SE)

(72) Inventor: Tommy Olsson, Mölndal (SE)

(73) Assignee: HUSQVARNA AB, Huskvarna (SE)

( * ) Notice: Subject to any disclaimer, the term of this patent is extended or adjusted under 35 U.S.C. 154(b) by 139 days.

(21) Appl. No.: 16/307,980

(22) PCT Filed: Jun. 9, 2017

(86) PCT No.: PCT/SE2017/050619
§ 371 (c)(1),
(2) Date: Dec. 7, 2018

(87) PCT Pub. No.: WO2017/213580
PCT Pub. Date: Dec. 14, 2017

(65) Prior Publication Data

US 2019/0161944 A1 May 30, 2019

(30) Foreign Application Priority Data

Jun. 9, 2016 (SE) ..... 1650806-1

(51) Int. Cl.
*E02F 9/26* (2006.01)
*E02F 3/96* (2006.01)
(Continued)

(52) U.S. Cl.
CPC ..... *E02F 9/265* (2013.01); *E02F 3/966* (2013.01); *E02F 9/2004* (2013.01);
(Continued)

(58) Field of Classification Search
CPC ..... E02F 9/265; E02F 9/2037; E02F 9/264; E02F 9/2004; E02F 9/2203; E02F 9/2246;
(Continued)

(56) References Cited

U.S. PATENT DOCUMENTS 3,896,951 A 7/1975 Seaberg et al.
5,065,326 A 11/1991 Sahm
(Continued)

FOREIGN PATENT DOCUMENTS

CN 101981262 A 2/2011
CN 105324540 A 2/2016
(Continued)

OTHER PUBLICATIONS

International Search Report and Written Opinion for International Application No. PCT/SE2017/050619, dated Sep. 5, 2017.
(Continued)

*Primary Examiner* — Marthe Y Marc-Coleman
(74) *Attorney, Agent, or Firm* — Burr & Forman, LLP

(57) ABSTRACT

A carrier comprising at least one hydraulic cylinder having a piston, a controller and a piston position sensor, wherein the carrier is arranged to carry a tool through the use of the hydraulic cylinder and wherein the controller is configured to: receive control input for moving the tool; receive piston position information for at least one piston of the at least one cylinders; determine a current angle for the tool based on the piston position information; and determine that the current angle approximates a desired angle, and in response thereto halt the tool at the desired angle. According to an aspect the controller may be configured to detect and determine the position of a subject relative the carrier based on hydraulic pressure information and tool operational information. Further, the application concerns methods applied with the embodiments of said carrier.

15 Claims, 8 Drawing Sheets

(51) Int. Cl.

| | |
|---|---|
| ***E02F 9/20*** | (2006.01) |
| ***E02F 9/22*** | (2006.01) |
| ***E04G 23/08*** | (2006.01) |
| ***E02F 3/43*** | (2006.01) |
| ***E02F 9/08*** | (2006.01) |

(52) U.S. Cl.
CPC ..... *E02F 9/2037* (2013.01); *E02F 9/2203* (2013.01); *E02F 9/2246* (2013.01); *E02F 9/264* (2013.01); *E02F 3/435* (2013.01); *E02F 9/085* (2013.01); *E04G 23/08* (2013.01)

(58) Field of Classification Search
CPC . E02F 3/966; E02F 3/435; E02F 9/085; E02F 3/43; E02F 3/437; E02F 9/20; E02F 9/2041; E04G 23/08; E04G 23/082; G05B 1/00; E21C 35/10
See application file for complete search history.

(56) References Cited

U.S. PATENT DOCUMENTS

| | | | | |
|---|---|---|---|---|
| 5,178,510 | A * | 1/1993 | Hanamoto | E02F 3/437 37/348 |
| 5,431,086 | A * | 7/1995 | Morita | F15B 11/048 60/469 |
| 8,428,791 | B2 | 4/2013 | Carlsson | |
| 2009/0218112 | A1 | 9/2009 | Mintah et al. | |
| 2012/0130599 | A1 | 5/2012 | Faivre et al. | |
| 2013/0333364 | A1 | 12/2013 | Carpenter et al. | |
| 2014/0166362 | A1 | 6/2014 | Farmer et al. | |
| 2014/0172246 | A1 | 6/2014 | Farmer et al. | |
| 2015/0019013 | A1 | 1/2015 | Rose et al. | |
| 2016/0040398 | A1 | 2/2016 | Kitajima et al. | |
| 2017/0089365 | A1* | 3/2017 | Perkins | F15B 21/08 |

FOREIGN PATENT DOCUMENTS

| | | | |
|---|---|---|---|
| DE | 2 620 809 | A1 | 11/1977 |
| EP | 0 811 726 | A1 | 12/1997 |
| EP | 2 508 680 | A1 | 10/2012 |
| JP | S60181429 | A | 9/1985 |
| JP | H10-18339 | A | 1/1998 |
| JP | 2765593 | B2 | 6/1998 |
| JP | H11-1937 | A | 1/1999 |
| JP | 2009-174197 | A | 8/2009 |
| JP | 2011252338 | A | 12/2011 |
| KR | 20-2013-0004193 | U | 7/2013 |
| SE | 536152 | C2 | 6/2013 |
| WO | 2000/016950 | A1 | 3/2000 |

OTHER PUBLICATIONS

Swedish Office Action and Search Report for Swedish Application No. 1650806-1, dated Dec. 16, 2016.
International Preliminary Report on Patentability for International Application No. PCT/SE2017/050619, dated Dec. 11, 2018.

* cited by examiner

ARRANGEMENT AND METHOD FOR OPERATING A HYDRAULICALLY OPERATED BOOM CARRYING A TOOL

TECHNICAL FIELD

This application relates to the operation of hydraulic booms or arms, and in particular to improved operation of hydraulic cylinders used to operate arms carrying construction or demolition tools.

BACKGROUND

When aligning a working tool carried by a hydraulically operated boom or arm it can be difficult for an operator to set a tool, such as a hydraulic hammer or drill, at the correct angle, which is most often perpendicular to the surface to be treated. This is due to the fact that the operator is mostly not positioned next to the tool for reasons of safety and convenience. The operator usually stands behind or next to the tool or sits in a driver's cabin.

It is important that a tool engages a subject at a correct angle or the load exerted on the tool may be at an angle impeding the operation of the tool. For example, if a hydraulic hammer or breaker engages a concrete wall at an angle that is not right and perpendicular to the subject, wherein the power exerted on the hammer by the boom is exerted in a direction that is right and perpendicular to the subject, the resulting forces in the tool will be at an angle which may cause damage to or increased wear of for example bushings of the tool. FIG. 5A illustrates the problem.

Especially for drills it is important that the drilled hole extends straight in and at an angle perpendicular to the subject being drilled.

Prior art solutions provide for maintaining a previously moved to or set angle, or to set an alignment angle automatically. However, the prior art manner of maintaining an angle does not solve how to set the angle correctly the first time, and the manner of automatically setting the angle takes away the control of the boom from the operator and may cause unexpected movement of the boom, thereby possibly endangering operators or bystanders.

There is thus a need for an alternative or additional solution for overcoming the drawbacks of the prior art, namely to provide proper alignment of a construction/demolition tool.

SUMMARY

One object of the present teachings herein is to solve, mitigate or at least reduce the drawbacks of the background art, which is achieved by the appended claims.

A first aspect of the teachings herein provides for a carrier comprising at least one hydraulic cylinder having a piston, a controller and a piston position sensor, wherein the carrier is arranged to carry a tool through the use of the hydraulic cylinder and wherein the controller is configured to: receive control input for moving the tool; receive piston position information for at least one piston of the at least one cylinders; determine a current angle for the tool based on the piston position information; and determine whether the current angle approximates a desired angle, and if so, halt the tool at the desired angle.

A second aspect provides a method for use in a carrier comprising at least one hydraulic cylinder having a piston, a controller and a piston position sensor, wherein the carrier is arranged to carry a tool through the use of the hydraulic cylinder and wherein the method comprises: receiving control input for moving the tool; receiving piston position information for at least one piston of the at least one cylinders; determining a current angle for the tool based on the piston position information; and determining whether the current angle approximates a desired angle, and if so, halting the tool at the desired angle.

One benefit is that an operator is thereby guided to a desired angle without ever losing control of the carrier or the tool.

A third aspect provides for a carrier comprising at least one hydraulic cylinder having a piston, the carrier further comprising a controller, a piston position sensor and a pressure sensor for detecting hydraulic pressure in at least one hydraulic cylinder, wherein the carrier is arranged to carry a tool through the use of the hydraulic cylinder and wherein the controller is configured to: receive control input for moving the tool towards a subject; receive tool operation information comprising at least piston position information for at least one piston of the at least one hydraulic cylinder; receive hydraulic pressure information for the at least one hydraulic cylinder; determine whether the tool is in contact with the subject based on the hydraulic pressure information, and if so; determine a position of the subject relative the carrier based on tool operation information.

A fourth aspect provides for a method for use in a carrier comprising at least one hydraulic cylinder having a piston, the carrier further comprising a controller, a piston position sensor and a pressure sensor for detecting hydraulic pressure in at least one hydraulic cylinder, wherein the carrier is arranged to carry a tool through the use of the hydraulic cylinder and wherein the method comprises receive control input for moving the tool towards a subject; receive tool operation information comprising at least piston position information for at least one piston of the at least one hydraulic cylinder; receive hydraulic pressure information for the at least one hydraulic cylinder; determine whether the tool is in contact with the subject based on the hydraulic pressure information, and if so; determine a position of the subject relative the carrier based on tool operation information.

It should be noted that even though the disclosure herein is focused on hydraulically operated booms and arms, the inventors have realized that the teachings herein may also be used for booms or arms operated in different manners, such as pneumatically or mechanically. The inventors have further realized that the position locators of the cylinders may also be used with such pneumatic or mechanical control wherein the position of an arm member may be determined in a corresponding fashion.

It should be noted that even though the disclosure herein is aimed at guiding an operator to finding a desired angle, the same teaching may be used for guiding an operator into finding a desired level for positioning the tool at.

The same controls and determinations would then be used, but for a level instead of an angle, the level being determined based on a level of the carrier.

The combination of guiding an operator for finding a desired angle and a desired level, may thus be used for guiding an operator in finding a desired working line along which the tool is to operate.

Such a combination may be beneficially used for guiding an operator in finding a working line for subsequent automatic feeding as in the concurrently filed application by the same inventor and applicant, entitled "IMPROVED ARRANGEMENT AND METHOD FOR OPERATING A HYDRAULICALLY OPERATED BOOM CARRYING A TOOL IN A CARRIER", wherein a working line is specified as a direction and a level along which a tool is moved during working operation.

Other features and advantages of the disclosed embodiments will appear from the following detailed disclosure, from the attached dependent claims as well as from the drawings.

BRIEF DESCRIPTION OF DRAWINGS

The invention will be described below with reference to the accompanying figures wherein.

DETAILED DESCRIPTION

Figure 1:
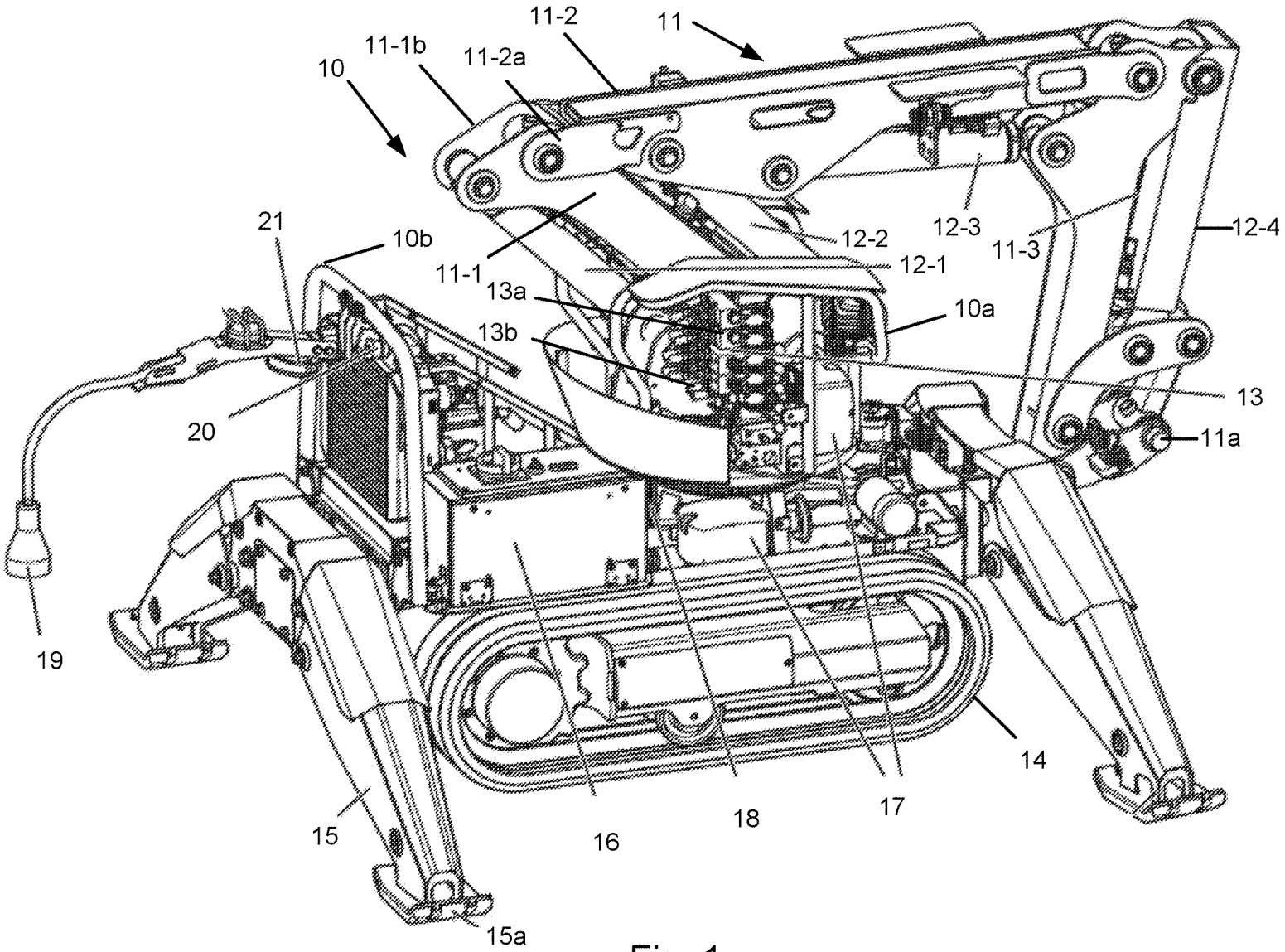
FIG. 1 shows a remote demolition robot according to an embodiment of the teachings herein.

FIG. 1 shows an example of carrier for a work tool, such as a construction tool or demolition tool for example a hammer (breaker) or a drill, which carrier in this example is a remote demolition robot 10, hereafter simply referred to as the robot 10. Although the description herein is focused on demolition robots, the teachings may also be applied to any engineering vehicle arranged to carry a tool, on an arm or boom system which is hydraulically controlled. In the following no difference will be made between a boom and an arm.

The robot 10, exemplifying the carrier, comprises one or more robot members, such as arms 11, but only one arm is shown in the figures of this application. The arm 11 possibly constitutes one (or more) robot arm member(s). One member may be a tool holder 11*a* for holding a tool 11*b* (not shown in FIG. 1, see FIG. 3). The tool 11*b* may be a hydraulic breaker or a drill. Other examples where the angle is important are cutters, grinders, saws, concrete rotary cutters, or a digging bucket to mention a few examples.

At least one of the arms 11 is movably operable through at least one hydraulic cylinder 12. The hydraulic cylinders are controlled through a hydraulic valve block 13 housed in the robot 10.

The hydraulic valve block 13 comprises one or more valves 13*a* for controlling the flow of a hydraulic fluid (oil) provided to for example a corresponding cylinder 12.

The robot 10 comprises caterpillar tracks 14 that enable the robot 10 to move. The robot 10 may alternatively or additionally have wheels for enabling it to move, both wheels and caterpillar tracks being examples of drive means. The robot may further comprise outriggers 15 that may be extended individually (or collectively) to stabilize the robot 10.

The robot 10 is driven by a drive system 16 operably connected to the caterpillar tracks 14 and the hydraulic valve block 13. The drive system 16 may comprise an electrical motor in case of an electrically powered robot 10 powered by a battery and/or an electrical cable 19 connected to an electrical grid (not shown), or a cabinet for a fuel tank and an engine in case of a combustion powered robot 10.

The body of the robot 10 may comprise a tower l0*a* on which the arms 11 are arranged, and a base 10*b* on which the caterpillar tracks 14 are arranged. The tower l0*a* is arranged to be rotatable with regards to the base 10*b* which enables an operator to turn the arms 11 in a direction other than the direction of the caterpillar tracks 14.

In detail, the arm 11 is arranged to carry the tool 11*b* (not shown) and comprises a first arm member 11-1, a second arm member 11-2, a third arm member 11-3 and a tool holder 11*a*. The arm members 11-1, 11-2, 11-3 and 11*a* are pivotally coupled to each other so that the arm 11 is articulated. One end (not shown) of the first arm member 11-1 is pivotally coupled to the carrier, e.g. to the tower 10*a* and the other end 11-1*b* is pivotally attached to an end 11-2*a* of the second arm member 11-2. Pivotal coupling between arm members and carrier may be provided by pivot shafts. It is appreciated that the third arm member 11-3 may be omitted whereby the tool 11*b* (not shown) may be directly coupled to the second arm member 11-2. Alternatively, the tool holder 11*a* may be directly coupled to the second arm member 11-2. It is also possible that the second arm member 11-2 is constituted by the tool holder 11*a*.

The carrier further comprises a first and a second hydraulic cylinder 12-1 and 12-2. The first hydraulic cylinder 12-1 is arranged to move the first arm member 11-1. That is, arranged to pivot the first arm member 11-1 around the pivotal coupling to the carrier. One end of the first hydraulic cylinder 12-1 (e.g. the end of the cylinder barrel) is thereby pivotally coupled to the carrier 10 and another end of the first hydraulic cylinder 12-1 (e.g. the end of the piston rod) is pivotally coupled to the end 11-1*b* of the first arm member 11-1. The second hydraulic cylinder 12-2 is arranged to move the second arm member 11-2. That is, to move the second arm member 11-2 around the pivotal coupling to the first arm member 11-1. One end of the second hydraulic cylinder 12-2 is thereby pivotally coupled to the carrier 10 and the other end of the second hydraulic cylinder 12-2 is pivotally coupled to the end 11-2*a* of the second arm member 11-2. A third hydraulic cylinder 12-3 may be arranged to move the third arm member 11-3 and a fourth hydraulic cylinder 12-4 may be arranged to move the tool holder 11*a* or the tool (not shown).

Thus, in the exemplary embodiment of FIG. 1, when the first hydraulic cylinder 12-1 is extended, the first arm member 11-1 is pivoted clockwise in a forward direction. When the first hydraulic cylinder 12-1 is retracted the first arm member 11-1 is pivoted counter-clockwise in a backward direction. When the second hydraulic cylinder 12-2 is extended, the second arm member 11-2 is pivoted counter-clockwise in an upwards direction. When the second hydraulic cylinder 12-2 is retracted the second arm member 11-2 is pivoted clockwise in a downwards direction.

The operation of the robot 10 is controlled by one or more controllers 17 comprising at least one processor or other programmable logic and possibly a memory module for storing instructions that when executed by the at least one processor or other programmable logic controls a function of the demolition robot 10. The one or more controllers 17 will hereafter be referred to as one and the same controller 17 making no differentiation of which processor is executing which operation. It should be noted that the execution of a task may be divided between the controllers wherein the controllers will exchange data and/or commands to execute the task.

The robot 10 comprises a control interface 22 which may be a remote control (see FIG. 2), but may also be an arrangement of levers, buttons and possibly steering wheels as would be understood by a person skilled in the art.

The robot 10 may further comprise a radio module 18. The radio module 18 may be used for communicating with the remote control (see FIG. 2, reference 22) for receiving commands to be executed by the controller 17. The radio module may be configured to operate according to a low energy radio frequency communication standard such as ZigBee®, Bluetooth® or WiFi®. Alternatively or additionally, the radio module 18 may be configured to operate according to a cellular communication standard, such as GSM (Global Systeme Mobile) or LTE (Long Term Evolution).

For wired control of the robot 10, the remote control 22 may alternatively be connected through or along with the power cable 19. The robot may also comprise a Human-Machine Interface (HMI), which may comprise control buttons, such as a stop button 20, and light indicators, such as a warning light 21.

Figure 2:
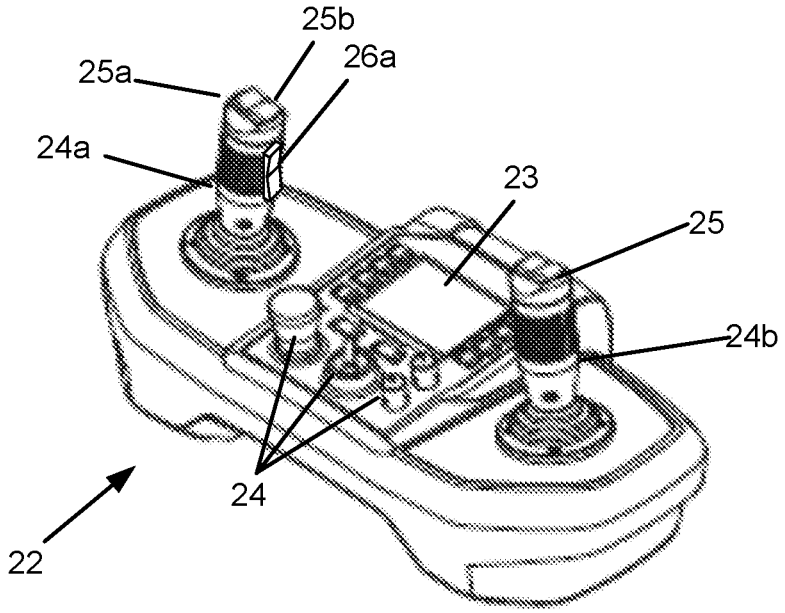
FIG. 2 shows a remote control 22 for a remote demolition robot according to an embodiment of the teachings herein.

FIG. 2 shows a remote control 22 for a remote demolition robot such as the robot 10 in FIG. 1. The remote control 22 has one or more displays 23 for providing information to an operator, and one or more controls 24 for receiving commands from the operator. The controls 24 include one or more joysticks, a left joystick 24*a* and a right joystick 24*b* for example as shown in FIG. 2, being examples of a first joystick 24*a* and a second joystick 24*b*. It should be noted that the labeling of a left and a right joystick is merely a labeling used to differentiate between the two joysticks 24*a*, 24*b*. A joystick 24*a*, 24*b* may further be arranged with a top control switch 25. The joysticks 24*a*, 24*b* and the top control switches 25 are used to provide maneuvering commands to the robot 10. The control switches 24 may be used to select one out of several operating modes, wherein an operating mode determines which control input corresponds to which action.

As touched upon in the above, the remote control 22 may be seen as a part of the robot 10 in that it may be the control panel of the robot 10.

The remote control 22 is thus configured to provide control information, such as commands, to the robot 10 which information is interpreted by the controller 17, causing the robot 10 to operate according to the actuations of the remote control 22.

Figure 3:
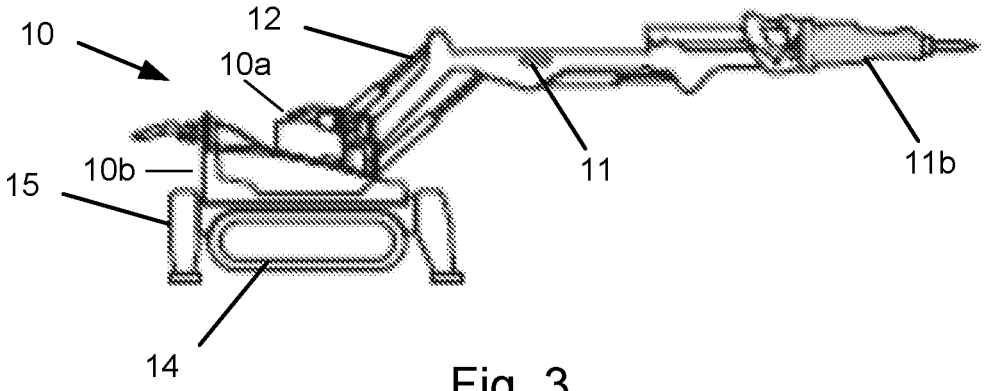
FIG. 3 shows a schematic view of a robot according to an embodiment of the teachings herein.

FIG. 3 shows a schematic view of a carrier, such as the robot 10 according to FIG. 1. In FIG. 3, the caterpillar tracks 14, the outriggers 15, the arms 11 and the hydraulic cylinders 12 are shown. A tool 11*b*, in the form of a hammer 11*b*, is also shown (being shaded to indicate that it is optional).

As the controller 17 receives input relating for example to moving a robot member 11, the corresponding valve 13*a* is controlled to open or close depending on the movement or operation to be made.

Figure 4:
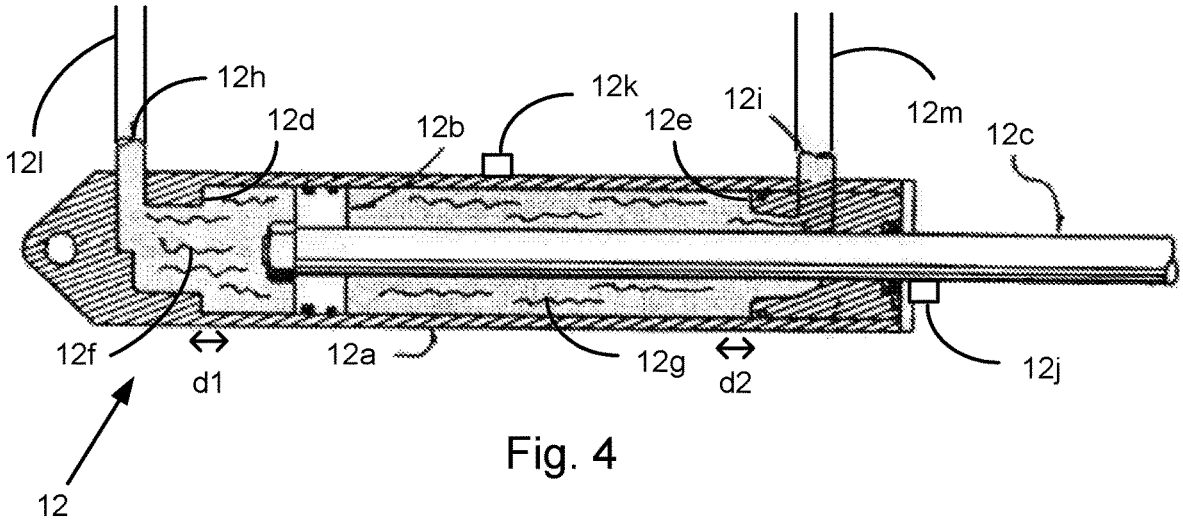
FIG. 4 shows a schematic view of a hydraulic cylinder according to an embodiment of the teachings herein.

FIG. 4 shows a schematic view of a hydraulic cylinder 12. The hydraulic cylinder 12 comprises a cylinder barrel 12*a*, in which a piston 12*b*, connected to a piston rod 12*c*, moves back and forth. The barrel 12*a* is closed on one end by the cylinder bottom (also called the cap) 12*d* and the other end by the cylinder head (also called the gland) 12*e* where the piston rod 12*c* comes out of the cylinder. Through the use of sliding rings and seals the piston 12*b* divides the inside of the cylinder 12*a* into two chambers, the bottom chamber (cap end) 12*f* and the piston rod side chamber (rod end/head end) 12*g*. The hydraulic cylinder 12 gets its power from a pressurized hydraulic fluid (shown as greyed out areas with wavy lines), which is typically oil, being pumped into either chamber 12*f*, 12*g* through respective oil ports 12*h*, 12*i* for moving the piston rod in either direction. The hydraulic fluid, being supplied through hydraulic fluid conduits 12*l*, 12*m*, is pumped into the bottom chamber 12*f* through the bottom oil port 12*h* to extend the piston rod and into the head end through the head oil port 12*i* to retract the piston rod 12*c*.

The hydraulic cylinder 12 is further arranged with a piston position sensor 12*j*. Many alternatives for a piston position sensor exist being of various magnetic, optical, and/or electrical deigns. The piston position sensor 12*j* is configured to determine the position of the piston 12*b* in the barrel 12*a*, possibly by determining the position of the piston rod 12*c* relative the barrel 12*a*.

The piston position sensor 12*j* may be an integrate part of the cylinder 12, or it may be an add-on feature that is attached to or assembled on the cylinder 12. The piston position sensor 12*j* is communicatively connected to the controller 17 for transmitting piston position information received by the controller 17 which enables the controller 17 to determine the position of the piston 12*b* in the barrel 12*a*.

The piston position sensor 12*j* may also or alternatively be arranged as an angle detector between two arm members 11 that are controlled by the hydraulic cylinder 12. By knowing the angle between two arm members, the controller may determine the position of the piston as, for a fixed pivot point, the angle will be directly proportional to the piston position.

The inventor has realized that by knowing the position of the pistons 12*b* in the cylinders 12, it is possible to overcome the drawbacks of the prior art especially as regards the wear and tear of the tool.

The inventor proposes an intelligent manner of actively guiding—not only informing—an operator to enable the operator to align a tool 11*b* correctly, without taking control of the movement of the arm 11 or the tool 11*b*.

Figure 5A:
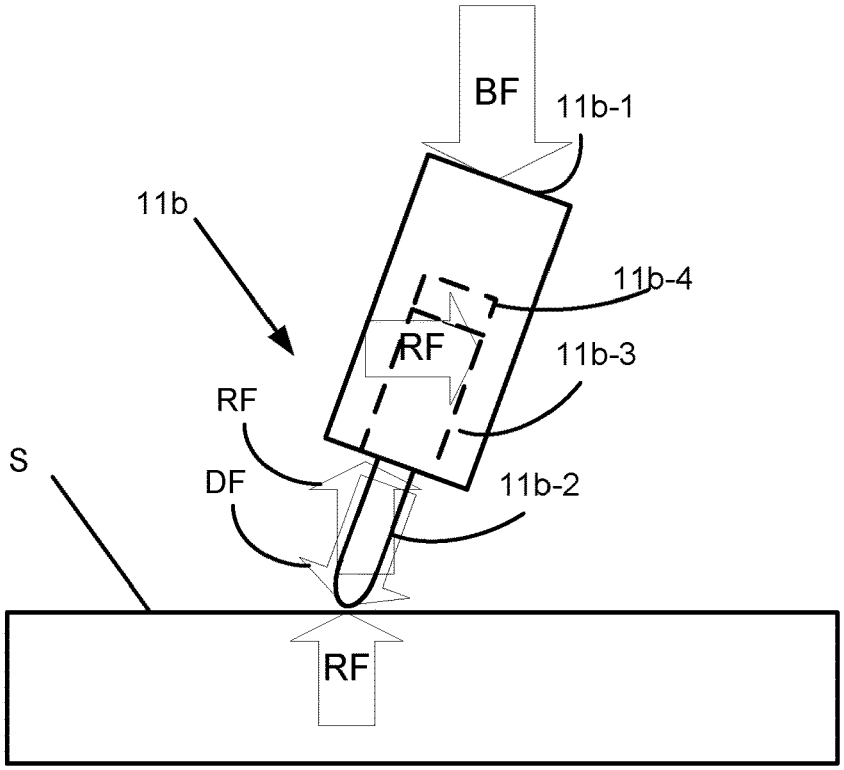
FIG. 5A shows a schematic view of tool arranged on a hydraulically operated arm engaging a subject at an incorrect angle according to a prior art solution.
Figure 5B:
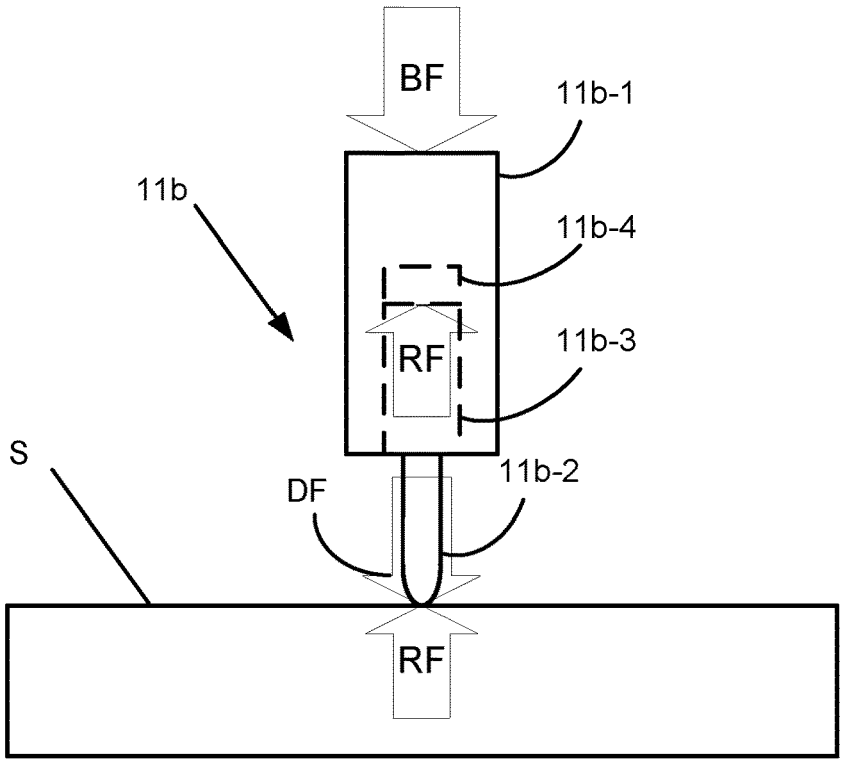
FIG. 5B shows a schematic view of tool arranged on a hydraulically operated arm engaging a subject at a correct angle according to an embodiment of the teachings herein.

Returning to the problem to be solved, FIG. 5A shows a schematic view of a tool 11*b* being aligned incorrectly with regards to a subject S to be treated or worked upon by the tool 11*b*. In this example the tool 11*b* is represented by a schematic hammer 11*b*. As can be seen in FIG. 5A, the hammer 11*b* comprises a casing 11*b*-1 and a chisel 11*b*-2. The chisel 11*b*-2 is movably arranged relative the casing 11*b*-1 and the movement is controlled partly by bushings 11*b*-3 in the casing 11*b*-1. The chisel 11*b*-2 is activated or driven by a driving element 11*b*-4 that is arranged to withstand (great) forces, both to deliver a driving force and to absorb any resultant forces. In FIGS. 5A and 5B such forces are indicated by arrows. The sizes of the arrows are only for illustrative purposes and the amplitude of the forces may not correspond to the size of the corresponding arrows.

During operation, the hammer 11*b* and the chisel 11*b*-2 are subjected to a driving force DF and driving the chisel 11*b*-2 into the subject S to be worked upon, the subject possibly being a floor or a wall or other structural component. The chisel 11*b*-2 is also subjected to a boom force, driving the hammer 11*b* towards the subject S, keeping the hammer 11*b* in place and possibly feeding it as the work progresses. As the chisel 11*b*-2 engages the subject S, it will be subjected to a reactive force RF from the subject S. The reactive force RF is translated through the chisel 11*b*-2 into the casing 11*b*-1 where the chisel 11*b*-2 engages the bushings 11*b*-3. If the chisel 11*b*-2 engages the subject S at an incorrect angle the reactive force RF will engage the bushings at locations/positions where the bushing and the hammer in general is not designed to absorb or handle the reactive forces which will lead to increased wear and tear of the hammer, a reduced efficiency of the hammer and also possibly risking damaging the hammer.

FIG. 5B shows a schematic view of a similar scenario, but here the tool 11*b* is aligned at a correct angle, in this case being perpendicular to the subject S and the reactive forces engage with the driving element 11*b*-4. The chisel 11*b*-2 will thus be able to move freely within its bushings 11*b*-3, whereby vibrations as well as any shocks, that the tool is subjected to, will be absorbed as was intended by the designers of the tool 11*b*.

The inventor provides a manner of reducing the wear and tear of a tool, as well as the stability and smoothness of operation, by configuring the controller 17 to receive piston position information for the piston (directly or indirectly) from a piston position sensor 12*j* and based on the piston position information, controlling the movement of the arms 11 and especially the tool holder arm for guiding an operator into aligning the tool 11*b* at a correct or desired angle.

Figure 6:
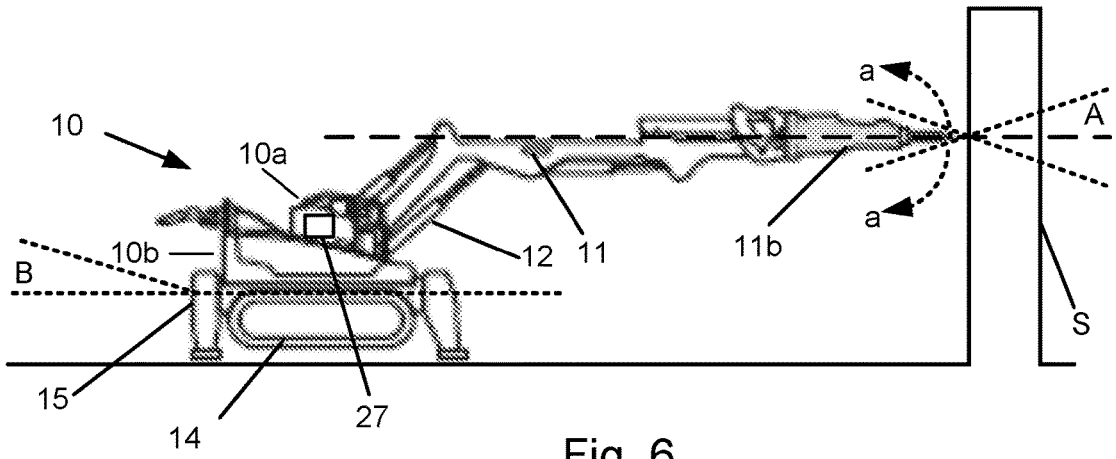
FIG. 6 shows a schematic view of tool arranged on a hydraulically operated arm engaging a subject according to an embodiment of the teachings herein.

FIG. 6 shows a schematic view of a demolition robot, as an example of a carrier 10, having a hammer, as an example of a tool 11*b*, engaging a wall, as an example of a subject to be worked upon.

A direction perpendicular to the subject S is indicated by a dashed line A in FIG. 6. An operator may maneuver the arms 11 and the tool 11*b* with respect to the subject S and thereby change an angle a at which the tool 11*b* engages the subject S. As has been discussed in the above it may be difficult for an operator to see when the tool is aligned at the correct angle. The controller is therefore configured to provide guidance to the operator when maneuvering the tool 11*b*. The guidance is provided by the tool snapping in to a position when the desired angle is obtained. This provides for clear guidance, without moving the tool by relieving the operator of control of the tool. The operator is thus in control of the tool's movement the entire time.

The controller 17 is configured to receive position information for the arm members 11, determine that the tool 11*b* is at a correct or desired angle based on the position information and in response thereto (temporarily) halt the movement of the tool 11*b*. The controller 17 is configured to determine that the tool is at the desired angle by approximately comparing the current angle with the desired angle. If the current angle is within an error tolerance of the desired angle, then the tool is determined to be at the desired angle. The error tolerance depends on the current tool and its design and may be less than 1 degree. The controller may further halt the tool 11*b* at the current angle approximating the desired angle, or assist in moving the tool 11*b* to the desired angle.

The controller may influence the control of the tool 11*b* for example by adapting or amending the control inputs received from the remote control 22, thereby adapting the control of the cylinders accordingly.

The controller 17 may also be configured to receive control input for rotating the tower 10*a*, and in response thereto adapting the desired angle.

The controller is thus configured to snap the tool 11*b* into position as the correct angle is obtained. This provides a clear guidance to the operator, while allowing the operator to have control of all the movements of the tool 11*b*.

To enable the operator to change the position of the tool 11*b*, perhaps another desired angle was aimed for, the operator may attenuate his controls, that is push harder on the joystick, to get passed the snapped position. In such a case, the controller is configured to temporarily remap the control input of a joystick or other command, to the hydraulic valve so that a smaller movement results from the attenuated control. Of course, the controller will ramp down this temporary remapping after a while when the tool is moving again, for example after 1, 2, 3 or 5 seconds, or when it is determined that the tool 11*b* is again travelling at a defined speed. The controller is thus configured to resume movement of the tool 11*b* after having received attenuated control input.

In an alternative or additional embodiment, the operator needs to keep the joystick or other command actuated and after a while the controller will again enable the tool 11*b* to be moved. The controller 17 is thus configured to determine a time since the desired angle was obtained and to determine that a corresponding control input for moving the tool 11*b* is still being received, and if the time since the desired angle was obtained exceeds a threshold time T ($t>T$) then continue moving the tool 11*b* or arm 11 according to the received control input.

In an alternative or additional embodiment, the controller is configured to increase the threshold time T, if it is determined that the speed of the tool, or the corresponding actuation of the corresponding control is decreased. This allows an operator more time to decide whether to accept the snapped to angle or not.

In an alternative or additional embodiment, the controller is configured to determine a speed at which the tool 11*b* is being moved, and if this speed (s) is below a threshold speed indicating a search speed (SS; $s<SS$) then activate the auto snap functionality as disclosed herein. Similarly, if the controller 17 determines that the speed of the tool 11*b* exceeds a travelling speed (TS; $s>TS$) then disabling the auto snap functionality as disclosed herein.

This enables the operator to move a tool passed one or more desired angles without the tool snapping into place which is good for when transporting or moving the tool, enabling the functionality to be used only when actually searching for a desired angle.

The travelling speed may be defined as above 10, 20 cm/s, 30 cm/s, 40 cm/s or 50 cm/s. The searching speed may be defined as below 20 cm/s, 10 cm/s, 5 cm/s, 3 cm/s, 2 cm/s or 1 cm/s.

The speeds, although given here as indications of distances per second, may alternatively or additionally be defined as angular distances per seconds.

In an alternative or additional embodiment, the travelling speed and/or the searching speed may be defined as an actuation of a corresponding control, such as a joystick. In such an embodiment, a certain speed would equate to a certain angle of the joystick, whereby the angle of the joystick would be used as the decisive measurement for when activating a mode. The travelling speed would then correspond to a higher or larger actuation of the control than the searching speed.

In an alternative or additional embodiment, the controller is configured to determine the current angle of the tool 11*b*, and if this angle (a) is below a threshold A indicating a proximity to a desired angle, then activate the auto snap functionality as disclosed herein and to remap the control input to the hydraulic valve to slow down the movement of the tool 11*b* in the vicinity of the desired angle to a (or below) a searching speed.

This enables the operator to quickly and easily find a desired angle by simply moving the tool 11*b* in the direction of the desired angle and let the controller guide him to the desired angle.

In an alternative or additional embodiment, the controller is configured to determine the current angle of the tool 11*b*, and if this angle (a) is within a second angular threshold (A2) of the desired angle (DA; a-DA<A2) then moving the tool 11*b* to the desired angle, by speeding up the tool 11*b* slightly, for example with an additional 5 cm/s or by an increase of 10% o, 15% or 20% in speed. By selecting the second angular threshold A2 to be small, for example 2 degrees, 1 degree, 0.5 degrees, there is no real control of the movement of the tool apart form a temporary acceleration of the tool followed shortly thereafter (less than a second) of the stopping of the tool thereby clearly snapping the tool into place and the operator is thus always in control of the tool 11*b*.

As has been indicated above, the controller may be configured to store more than one desired angle. The controller will thus act as above in the vicinity of each stored desired angle.

The desired angle may be defined as perpendicular to an assumed work surface of a subject. For example, if the controller determines that the hammer is angled substantially downwards, presumably for engaging a floor, the desired angle may be defined as 270 degrees or −90 degrees, if the controller determines that the hammer is angled substantially upwards, presumably for engaging a ceiling, the desired angle may be defined as 90 degrees and if the controller determines that the hammer is angled substantially horizontally, presumably for engaging a wall, the desired angle may be defined as 0 degrees.

The desired angle may also be adapted according to a detected lean angle of the robot 10. The robot 10 may be arranged with a lean sensor 27, such as a gyroscope, for detecting an angle B that the body 10*a*/10*b* of the robot 10 is currently at. This lean angle B provides for a base line (indicated by a dotted line in FIG. 6) for adapting the angle a of the tool 11*b* for alignment with a desired angle, even when the robot 10 is not placed level. The controller 17 is thus configured to receive a lean angle (B) reading from a lean sensor 27, and to adapt the current angle a of the tool 11*b* accordingly for alignment with a desired angle. The angle may be adapted by adding the lean angle to the current angle a, or by subtracting the lean angle B from the desired angle.

The lean angle B may alternatively or additionally be derived from the position of the outriggers 15.

In one embodiment the controller 17 may also be arranged to receive a first subject position reading, by the operator moving the tool 11*b* into contact with the subject at a first position on the subject, subsequently receiving a second subject position reading, by the operator moving the tool 11*b* into contact with the subject at a second position on the subject, and determine a surface angle of the subject relative the arm 11 or tool (11*b*) based on the first and second subject positions, the desired angle then being perpendicular to a line connecting the first and second subject positions, and parallel to the tool's current sideways (or tilting) angle.

In such an embodiment, the controller may further be configured to receive a third subject position reading, by the operator moving the tool 11*b* into contact with the subject at a third position on the subject, and determine a surface angle of the subject relative the arm 11 or tool 11*b* based on the first, second and third subject positions, the desired angle then being perpendicular to a plane encompassing the first, second and third subject positions.

The desired angle may also be input to the controller 17 through the remote control 22 or via the radio module 18 or the HMI.

The speed thresholds (both or individually) may also be input to the controller 17 through the remote control 22 or via the radio module 18 or the HMI.

The angular thresholds may also be input to the controller 17 through the remote control 22 or via the radio module 18 or the HMI.

It should be noted that for drills for example, the desired angle need not be perpendicular to the subject.

Figure 7:
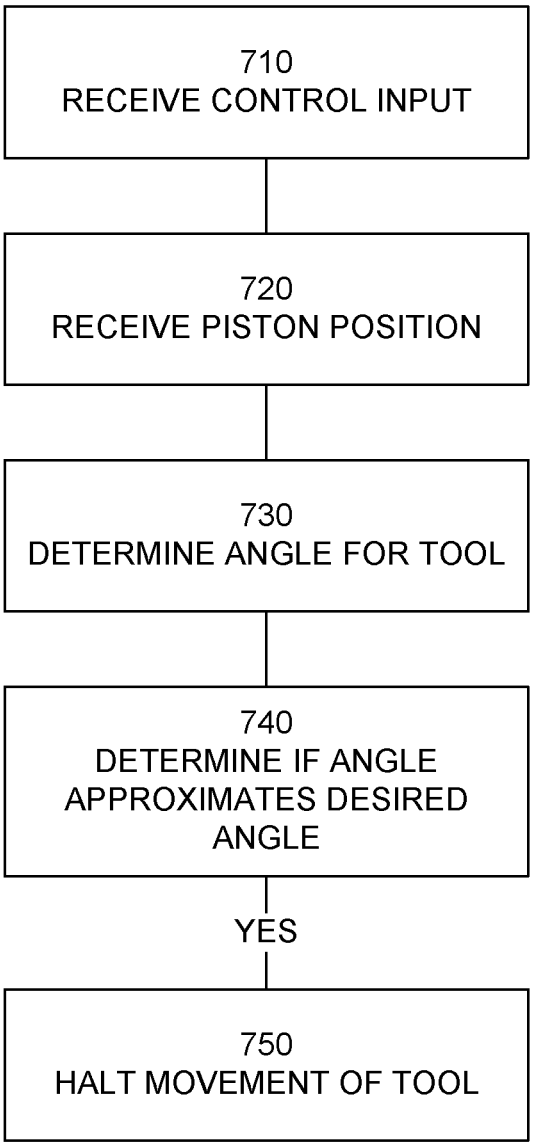
FIG. 7 shows a flowchart for a general method according to an embodiment of the teachings herein.

FIG. 7 shows a flowchart for a general method according to herein. The controller receives control input 710 for moving the tool 11*b*, which ensures that an operator is actively controlling the tool. Then the controller receives piston position information 720 for at least one piston of the at least one cylinders and determines 730 a current angle (a) for the tool 11*b* based on the piston position information. The controller then determines that the current angle approximates 740 a desired angle, and if so halts 750 the tool (11*b*) at the desired angle.

Following is described an embodiment of a carrier according to a third aspect of the present disclosure. It is appreciated that in the following description, where not otherwise indicated, the carrier according to the third aspect of the present disclosure is identical to the carrier of the first aspect which is described in embodiments hereinabove.

Thus, the carrier 10 according to the third aspect comprises all features of the carrier 10 according to the first aspect shown in FIGS. 1-7 and described in detail hereinabove. Where appropriate, in description of features hereinafter reference may be made to FIGS. 1-7.

Figure 8:
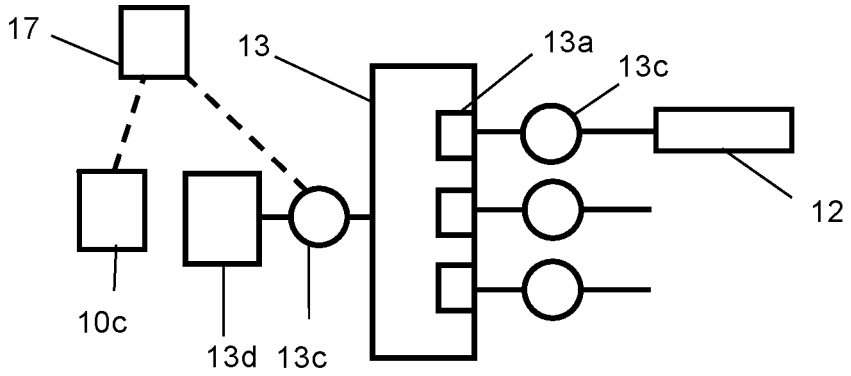
FIG. 8 shows schematically features of a carrier according to a third aspect of the disclosure.

Turning to FIG. 8. In addition to the features already described hereinabove, the carrier 10 according to the third aspect comprises at least one pressure sensor 13*c* for detecting the hydraulic pressure in at least one hydraulic cylinder of the carrier. FIG. 8 shows schematically the hydraulic valve block 13 of the carrier 10 and a hydraulic fluid pump 13*d* The hydraulic fluid pump 13*d* is comprised in the carrier 10 for supplying hydraulic fluid to at least one of the hydraulic cylinders 12 of the arm 11 of the carrier (not shown). The pressure sensor 13*c* may be arranged between the hydraulic fluid pump 13*d* and the hydraulic valve block 13. The fluid sensor 13*c* may thereby detect the total pressure of the hydraulic cylinders 12 of the arm 11. Alternatively, at least one hydraulic pressure sensor 13*c* may be arranged between at least one of the valves 13*a* of the hydraulic valve block 13 and at least one hydraulic cylinder 12 of the arm 11. This provides the possibility to detect the pressure of individual hydraulic cylinders 12 of the arm 11. For example, the hydraulic pressure sensor may be P3354 hydraulic pressure sensor, commercially available from the company Tecsis.

The hydraulic pressure sensor 13*c* may be an integrate part of the carrier 10, or it may be an add-on feature that is attached to or assembled on the carrier 10. The hydraulic pressure sensor 13*c* is communicatively connected to the controller 17 for transmitting hydraulic pressure information to the controller 17 which enables the controller 17 to determine the hydraulic pressure in the hydraulic cylinders of the arm 11.

The carrier may further comprise a tool angle sensor 10*c* for determining the angular position of the tool 11*b* (not shown) relative the carrier. For example, the tool angle sensor is a rotary encoder. In the embodiment shown in FIG. 1, the tool 11*b* is arranged on an arm 11 that is arranged on a tower 10*a* which is rotatable on the base of the carrier. The rotary encoder (not shown) may thereby be arranged to determine the angular position of the tower 10*a* as the tower 10*a* is rotated around a vertical axis. This in turn provides the angular position of the arm 11 carrying the tool 11*b* relative a vertical axis through the center of the tower (a vertical axis through the tower of the carrier is shown in FIGS. 9*b*-9*d*). The tool angle sensor 10*c* is communicatively connected to the controller 17 for transmitting tool angle information to the controller 17 which enables the controller 17 to determine the angular position of the tool 11*b* relative the carrier 10.

The inventor has realized that by combining the knowledge of the position of the pistons 12*b* in the hydraulic cylinders 12 with the knowledge of the hydraulic pressure in the cylinders 12 and, in embodiments, with the angular position of the tool relative the carrier it is possible to overcome drawbacks in the prior art. In particular it is possible to determine the position of a subject relative the carrier. This further makes possible to correctly position carrier 10 relative the subject.

In summary, the tool 11*b* of the carrier 10 is used as a feeler to determine the position of a subject in the surroundings of the carrier.

Figure 9A:
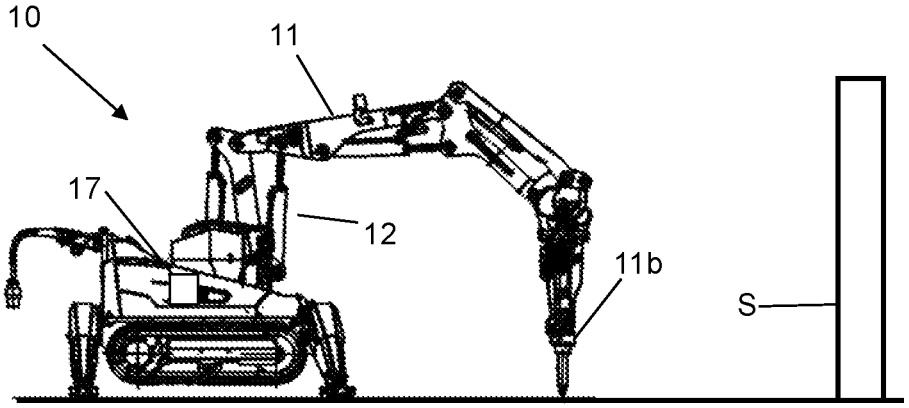
FIGS. 9*a*-9*d* shows schematically alternatives of a carrier according to a third aspect of the present disclosure.
Figure 9B:
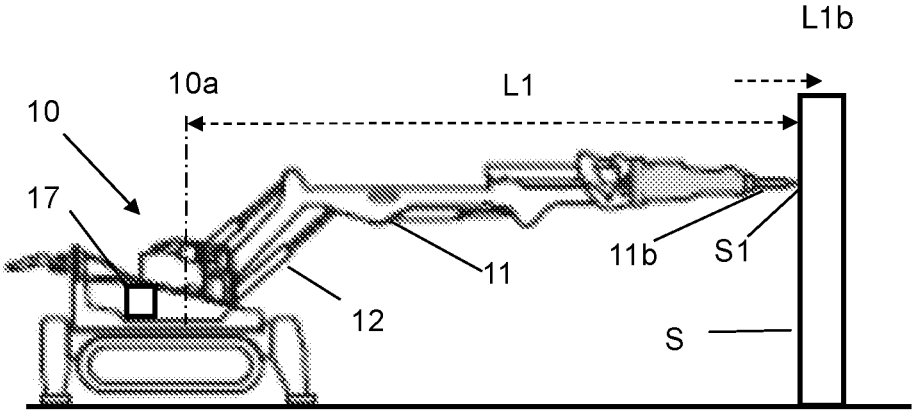
Figure 9C:
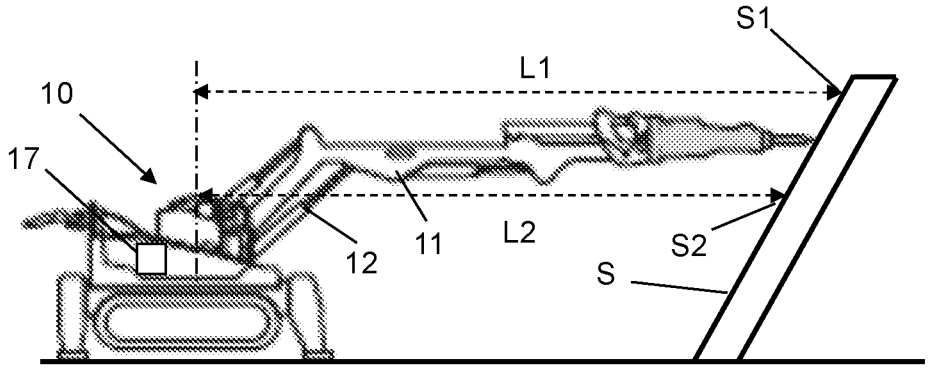
Figure 9D:
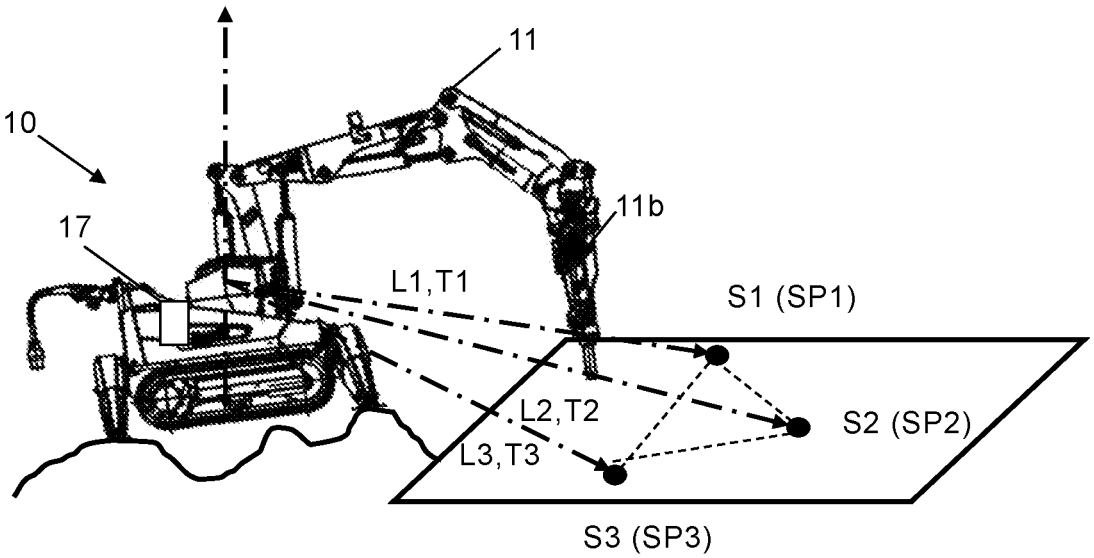

FIG. 9*a* shows a carrier 10 in a position relative a subject S in the form of wall.

The controller 17 of the carrier 10 is thereby configured to receive control input for moving the tool 11*b* towards the a subject S. The controller 17 may thereby control actuation of the hydraulic cylinders 12 to extend the arm 11 towards the subject S. The controller 17 thereby control the corresponding valves 13*a* of the cylinder block 13. Control input may for example be provided from a remote control 22 (see FIG. 2) operated by e.g. an operator of the carrier.

During movement of the tool 11*b*, the controller 17 is further configured, to receive tool operation information. The tool operation information includes piston position information from the piston sensors 12*j* of the hydraulic cylinder 12 of the arm 11.

In embodiments, the controller may further be configured to receive tool operation information that includes tool angle information from the tool angle sensor 10*c*.

The controller 17 is further configured to receive hydraulic pressure information from the at least one hydraulic pressure sensor 13*c*. The controller 17 is also configured to determine, based on the hydraulic pressure information, whether the tool 11*b* is in contact with the subject.

FIG. 9*b* shows the carrier 10 of FIG. 9*a*, when the tool 11*b* has been moved into contact with the subject S.

The hydraulic pressure in a hydraulic cylinder 12 depends on the load acting on its piston. Therefore, the hydraulic pressure of the hydraulic cylinders 12 of the arm of the carrier 10 is initially low during movement of the tool 11*b* since the tool 11*b* is moving through the air. However, as soon as the tool 11*b* comes in contact with the subject S there will be a load on the tool 11*b* and the hydraulic pressure in the hydraulic cylinders 12 will increase. Consequently, the controller 17 may be configured to determine contact between the tool 11*b* and the subject S as an increase in the hydraulic pressure which is received by the controller as hydraulic pressure information.

The controller 17 is further configured to, when the tool 11*b* is in contact with the subject, determine the position of the subject relative the carrier based on tool operation information. According to one alternative the position of the subject relative the carrier may be the distance between the subject S and carrier, e.g. between the subject S and the vertical center of the tower 10*a* of the carrier. According to another alternative, the position of the subject relative the carrier may be a surface angle of the subject. In other words, the angular position of the subject relative the carrier. To determine the distance between the carrier and the subject, it suffice that the tool come into contact with one site, i.e. a point or position, on the subject S.

The piston position information determines the position of the piston 12*b* in the barrel 12*a* of the cylinder. Based on this information, the controller 17 may determine how far the piston 12*b* has moved the tool 11*b* until the tool 11*b* contacted the subject S and based thereon determine the distance between the carrier and the subject. Typically, as shown in FIG. 1, the tool is arranged on an arm 11 that may comprise several arm members 11-1-11-3 and several hydraulic cylinder 12-1-12-4 arranged to move the arm members. Based on piston position information from the respective hydraulic cylinders, the controller 17 may be configured to determine to what extent and by which angle the respective arm member has been moved and therefrom determine the distance between the carrier 10 and the subject S. It is appreciated that the controller 17 may be configured to comprise information about dimensions of the tool 11*b*, such as the length of the tool 11*b*. The controller 17 may also be configured to comprise information about dimensions, such as length, of the respective arm members. This information may be used by the controller to determine the distance between the subject S and the carrier 10.

Returning to FIG. 9*a*, showing an embodiment, in which the tool 11*b* arranged on an arm 11 has been moved towards and in contact with a first site S1 on a subject S in the form of a wall. Based on piston position information from the cylinders 12 of the arm the controller 17 may determine the distance L1 between the site S1 on the surface of the subject S and the carrier 10.

The determined distance L1 between carrier 11 and the subject S may be used in combination with an image/video system that is communicatively connected to the controller 17 (not shown). For example in order to measure and calibrate distance to a wall that is visible in the image/video system. It is also possible to use the determined distance to program the controller to avoid hitting objects around the carrier with the arm, for instance.

To determine a surface angle of the subject S relative, the tool 11*b*, it is provided that the tool 11*b* contact at least a first and a second separate site on the subject.

FIG. 9*b* shows an embodiment in which the tool 11*b* of the carrier 10 has been moved towards and in contact with a first site S1 and a second site S2 on the subject S. Based on piston position information from the cylinders 12 of the arm the controller 17 may determine a first distance L1 and a second distance L2 between the respective first and the second sites S1, S2 on the subject S and the carrier 10. Based on the first and the second distances L1, L2 the controller may determine a surface angle of the subject S relative the carrier 10.

In the embodiment of FIG. 9*b*, the carrier 10 is in front of a subject S which is an inclined wall. Therefore the angular position of the subject S relative the carrier is relatively simple and a first and second distance L1, L2 suffices to determine the angular position of the subject relative the carrier. That is, the angle of a line (not shown) through the first and the second sites S1, S2 may be equal to or indicative of the surface angle of the subject S relative the carrier.

Returning to the embodiment shown in FIG. 9*a*. A further advantage of the carrier 10 according to the disclosure is that it may easily engage and machine (demolish) a subject S to desired depth. The carrier may thereby be configured to determine the first distance L1 between the carrier 10 and the subject and as a start level. The controller 17 may further be configured to move the tool, in machining mode, further towards the surface until a desired distance L1*d* between the carrier and the subject is determined.

FIG. 9*d* shows a situation in which the angular position of the subject S relative the carrier 10 is relatively complex. In this case the carrier 10 is placed on an uneven surface, such as accumulated demolition rubble, and the surface of the subject S may be uneven.

In this embodiment, the controller 17 is configured to move the tool 11*b* towards and in contact with a first site S1 on the subject S. The controller 17 is further configured to determine a first site position SP1 on the subject S relative the carrier 10. The first site position SP1 is determined by a first distance L1 between the first site S1 on the subject S and the carrier 10 and by a first tool angle T1. The tool angle T1 is the angular position of the tool 11*b* relative the carrier 10 when the tool 11*b* is in contact with the subject at site S1.

The controller 17 is further configured to move the tool 11*b* towards and in contact with a second site S2 on the subject S and to determine a second site position SP1. The second site position SP2 is determined by a second distance L2 between the second site S2 on the subject S and the carrier 10 and by a second tool angle T1.

The controller 17 is further configured to move the tool 11*b* towards and in contact with a third site S3 on the subject S and to determine a third site position SP3. The third site position SP3 is determined by a third distance L3 between the third site S3 on the subject S and the carrier 10 and by a third tool angle T1.

The three sites S1-S3 are selected by e.g. the operator of the carrier such that they are spaced apart in three dimensions over the surface of the subject S and thereby enclose a plane. The controller 17 may further be configured to determine a surface angle of the subject relative the carrier. The controller may thereby be configured to determine the surface angle of a plane enclosed by the sites SP1, SP2, SP3 relative the carrier 10, based on the distances L1, L2 and L3 and the tool angles T1, T2, T3. The surface angle of the plane may be equal to or indicative of the surface angle of the subject S relative the carrier 10. By determining further site positions, the correlation between the surface angle of plane and the actual surface angle of the subject may be increased and the accuracy of the determined surface angle relative the carrier may be improved.

The determined surface angles may be used by the controller 17 to properly align the tool 11*b* in a desired tool angle with the subject S. This is advantageous since it reduces wear of the tool 11*b* as described hereinabove.

When the surface angle is determined from two distances L1, L2 (as shown in FIG. 9*c*) the desired tool angle may be a perpendicular to a line connecting the first and the second positions on the subject S.

When the surface angle is determined from plane encompassing the first, second and third sites S1, S2, S3 on the subject S the desired tool angle may be a perpendicular to the plane.

The controller 17 may further be configured to determine a desired angle for the tool 11*b* based on the surface angle of the subject relative the carrier and to move the tool 11*b* until the current tool angle approximates a desired angle. This feature is described in detail under the first aspect of the carrier according to the present disclosure.

Figure 10:
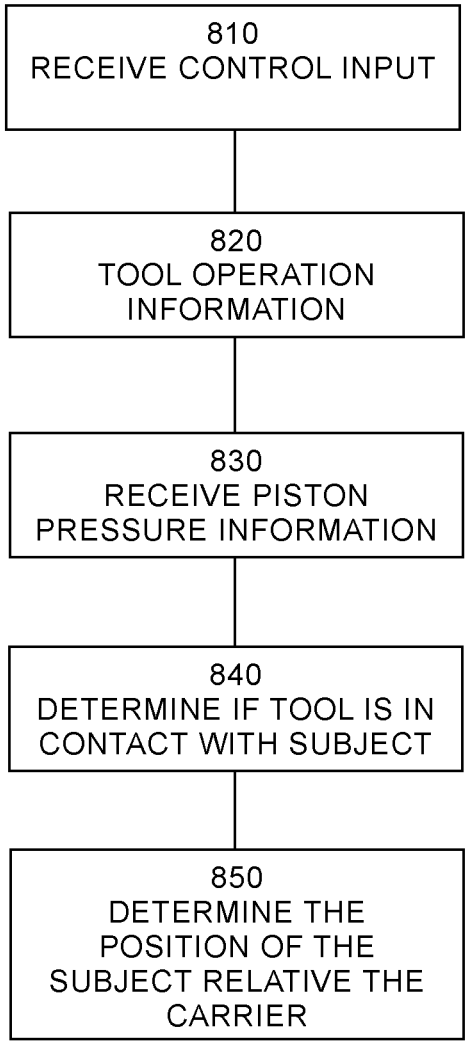
FIG. 10 shows a flowchart for a general method according to a fourth aspect of the present disclosure.

FIG. 10 shows a flowchart for a general method according to the fourth aspect of the present disclosure. The controller receives 810 control input for moving the tool 11*b* towards a subject. Then the controller receives tool operation information 820 including at least piston position information. Then the controller receives piston pressure information 830 for at least one hydraulic cylinder and determines 840 whether the piston is in contact with the subject. The controller then determines 850 a position of the subject relative the subject based on tool operation information.

The invention has mainly been described above with reference to a few embodiments. However, as is readily appreciated by a person skilled in the art, other embodiments than the ones disclosed above are equally possible within the scope of the invention, as defined by the appended patent claims.

For example:

The controller 17 may be configured to determine a working area for the tool 11*b* based on a plane that encompasses at least a first, second and third site S1, S2, S3 on a subject S as described above. In operation, the controller 17 may be configured to machine the area of the surface of the subject S that is limited by the plane. This alternative may be combined with the feature of moving the tool, in machining operation, towards the subject S until a desired distance Ld1 is reached. As described under FIG. 9*a*.

The length of the tool 11*b* of the carrier may vary over time due to wear or change of tool. Since this may influence the total length of the arm it may be necessary calibrate the controller on occasion. Calibration may be performed by placing the carrier on a known surface and bringing the tool in contact with the known surface. The position of the arm is determined from piston position information. The length of the tool may subsequently be determined as the distance from the floor level to the calculated position of the arm.

It is further appreciated that the expression: "position of a subject relative the carrier" is equivalent to "the position of the carrier relative the subject" It is also appreciated that the reference to the "carrier" in this context also includes the tool 11*b* or the arm 11.

It is further appreciated that the expression "moving the tool 11*b*" may include moving the arm 11 or moving the carrier 10 or moving both the arm 11 and the carrier.

Likewise, the expression: "subject surface angle relative the carrier" also includes "subject surface angle relative the tool 11*b*" and/or "subject surface angle relative the arm 11"

The invention claimed is:

1. A carrier comprising at least one hydraulic cylinder having a piston, the carrier further comprising a controller and a piston position sensor, wherein the carrier is arranged to carry a tool via the at least one hydraulic cylinder and wherein the controller is configured to:

receive control input for moving the tool from a control interface operated by a user;

receive piston position information for at least one piston of the at least one cylinders from the piston sensor;

determine a current angle for the tool based on the piston position information; and determine whether the current angle approximates a desired angle, and if so, automatically adapt the control input from the control interface operated by the user to halt the tool at the desired angle;

wherein, via the control interface, the user maintains control of all movements of the tool.

2. The carrier according to claim 1, wherein the controller is further configured to determine that the current angle approximates the desired angle by comparing the current angle with the desired angle, and if the current angle is within an error tolerance of the desired angle, then the tool is determined to be at the desired angle.

3. The carrier according to claim 1, wherein the controller is further configured to receive attenuated control input and in response thereto resume movement of the tool.

4. The carrier according to claim 1, wherein the controller is further configured to determine a time since the desired angle was obtained and to determine that a corresponding control input for moving the tool is still being received, and if the time since the desired angle was obtained exceeds a threshold time then resume the movement of the tool according to the received control input.

5. The carrier according to claim 1, wherein the controller is further configured to receive a first subject position reading, by the operator moving the tool into contact with the subject at a first position on the subject, receive a second subject position reading, by the operator moving the tool into contact with the subject at a second position on the subject, and determine a surface angle of the subject relative to the tool based on the first and second subject positions, the desired angle then being perpendicular to:

a line connecting the first and second subject positions and parallel to the tool's current angle; or a plane encompassing the first, second, and third subject positions.

6. The carrier according to claim 1, wherein the tool is a hammer, a drill, or a remote demolition robot.

7. The carrier according to claim 1, wherein the controller is configured to guide an operator maneuvering the tool to align the tool with regards to a subject to be engaged by the tool.

8. A carrier comprising:

a hydraulic cylinder comprising a piston;

a controller; and a piston position sensor configured to determine a position of the piston within the hydraulic cylinder;

wherein the carrier is arranged to carry a tool via the hydraulic cylinder; and wherein the controller is configured to:

receive control input for moving the tool from a control interface operated by a user;

cause the tool to be moved based on the control input from the control interface operated by the user; and while the control input continues to be received and the tool is moving based on the control input from the control interface operated by the user:

receive piston position information for the piston of the hydraulic cylinder from the piston position sensor;

determine, based on the piston position information, a current angle for the tool; and determine whether the current angle approximates a desired angle, and if so, automatically adapt the control input from the control interface operated by the user to halt the tool at the desired angle.

9. The carrier of claim 8, wherein the controller is configured to determine the current angle for the tool, the current angle for the tool being defined relative to a surface to be acted upon by the tool.

10. The carrier of claim 8, wherein the controller is configured to cause the tool to be moved based on the control input from the control interface operated by the user, the control input corresponding to current physical movements of the user interacting with the control interface.

11. The carrier of claim 8, wherein the controller is further configured to cause all movement of the tool to be based on the control input, the control input corresponding to current physical movements of the user interacting with the control interface.

12. A carrier comprising:

a hydraulic cylinder comprising a piston;

a controller; and a piston position sensor configured to determine a position of the piston within the hydraulic cylinder;

wherein the carrier is arranged to carry a tool via the hydraulic cylinder; and wherein the controller is configured to:

receive control input for moving the tool from a control interface operated by a user;

cause the tool to be moved based on the control input from the control interface operated by the user; and while the control input continues to be received and the tool is moving based on the control input from the control interface operated by the user:

receive piston position information for the piston of the hydraulic cylinder from the piston position sensor;

determine, based on the piston position information, a current angle for the tool; and determine whether the current angle approximates a desired angle, and if so, halt the tool at the desired angle;

wherein the controller is further configured to, while the control input continues to be received and the tool is moving based on the control input from the control interface operated by the user, determine whether the current angle is within a threshold range of the a desired angle, and if so, slow movement of the tool to a searching speed.

13. A carrier comprising:

a hydraulic cylinder comprising a piston;

a controller; and a piston position sensor configured to determine a position of the piston within the hydraulic cylinder;

wherein the carrier is arranged to carry a tool via the hydraulic cylinder; and wherein the controller is configured to:

receive control input for moving the tool from a control interface operated by a user;

cause the tool to be moved based on the control input from the control interface operated by the user; and while the control input continues to be received and the tool is moving based on the control input from the control interface operated by the user;

receive piston position information for the piston of the hydraulic cylinder from the piston position sensor;

determine, based on the piston position information, a current angle for the tool; and determine whether the current angle approximates a desired angle, and if so, halt the tool at the desired angle;

wherein the controller is further configured to, while the control input continues to be received and the tool is moving based on the control input from the control interface operated by the user, determine whether the current angle is within a threshold range of the a desired angle, and if so, remap a responsiveness to the control input.

14. The carrier of claim 13, wherein the controller is further configured to discontinue remapping of the responsiveness to the control input based upon expiration of a timer.

15. The carrier of claim 13, wherein the controller is further configured to discontinue remapping of the responsiveness to the control input in response to an attenuated control input, the attenuated control input corresponding to greater than a threshold change in physical movements of the user interacting with the control interface.

* * * * *